United States Patent [19]

Füglistaller et al.

[11] Patent Number: 4,890,793

[45] Date of Patent: Jan. 2, 1990

[54] ATOMIZER NOZZLE

[75] Inventors: Cornel Füglistaller, Jonen; Jakob Keller, Dottikon; Thomas Sattelmayer, Mandach, all of Switzerland

[73] Assignee: BBC Brown Boveri AG, Baden, Switzerland

[21] Appl. No.: 151,612

[22] Filed: Feb. 2, 1988

[30] Foreign Application Priority Data

Feb. 13, 1987 [CH] Switzerland ..... 545/87

[51] Int. Cl.[4] ..... B05B 1/28; B05B 7/06; F23D 11/12

[52] U.S. Cl. ..... 239/427; 239/424; 239/290

[58] Field of Search ..... 239/399, 424, 427, 547, 239/499, 504, 432, 290

[56] References Cited

U.S. PATENT DOCUMENTS

| | | | |
|---|---|---|---|
| 2,970,772 | 2/1961 | Boosinger et al. | 239/424 X |
| 3,739,989 | 6/1973 | Vosper | 239/399 |
| 4,427,367 | 1/1984 | Yagisawa | 239/424 X |
| 4,699,587 | 10/1987 | Shimoda et al. | 239/547 X |
| 4,708,293 | 11/1987 | Graziadio et al. | 239/427 |

FOREIGN PATENT DOCUMENTS

| | | |
|---|---|---|
| 92002 | 4/1982 | European Pat. Off. . |
| 149901 | 12/1984 | European Pat. Off. . |
| 1245788 | 10/1960 | France . |

OTHER PUBLICATIONS

"Airblast Atomization", Arthur H. Lefebvre; Prog. Energy Combust. Sci., vol. 6, pp. 233–261.

*Primary Examiner*—Andres Kashnikow
*Assistant Examiner*—Kevin P. Weldon
*Attorney, Agent, or Firm*—Oblon, Spivak, McClelland, Maier & Neustadt

[57] ABSTRACT

The atomizer nozzle exhibits an internal chamber (1) and an external chamber (2) which surrounds the latter in the form of a jacket, which chambers are provided with several outlet openings (9, 10 and 11, 12) which are in alignment in each case. A proportion of the atomizer air supplied via an air duct (5) flows into the internal chamber (1) and is essentially used there for uniformly distributing a liquid fuel, which is also flowing into the internal chamber (1) from a fuel duct (3), to its outlet openings (9, 10). The remaining greater proportion of the atomizer air flows around the internal chamber (1) through the external chamber (2) and is concentrically mixed in with the coarsely atomized fuel emerging from the outlet openings (9, 10) of the internal chamber (1). This prevents liquid fuel fragments from coming into contact with the walls of the outlet openings (11, 12) of the external chamber (2), and a high atomization quality is achieved.

8 Claims, 1 Drawing Sheet

ATOMIZER NOZZLE

BACKGROUND OF THE INVENTION

1. Field of the Invention

The present invention relates to an atomizer nozzle for atomizing liquid fuel with an air supply.

In atomization with an air supply, the energy required for the atomization is exclusively or at least mainly taken from the atomizer air.

The atomization is carried out for the subsequent combustion of the fuel. The aim is that the atomization be as fine as possible.

The atomizer nozzle is intended to form the head of the burner lance of a gas turbine burner so that the latter is also constructed for burning liquid fuel. In particular, it is intended to be used in a gas turbine burner having several burner lances arranged at an annular combustion chamber.

2. Discussion of Background

Various atomizer nozzles of the type initially mentioned are known from an article by Arthur H. Lefebvre, "Airblast Atomization", Prog. Energy Combust. Sci., Vol. 6, pp. 233–261, Pergamon Press Ltd, 1980.

However, the known atomizer nozzles are all unsuitable for the intended use in a gas turbine burner, particularly with several burner lances arranged at an annular combustion chamber. This applies particularly with respect to their spatial atomization characteristic. It is too highly centered. An atomizer nozzle which can be used in the intended context must exhibit a much more fanned-out atomization characteristic in order to ensure cross-ignition between adjacent burner lances of the same combustion chamber. On the other hand, the flame must be maintained despite the wide atomization characteristic when the fuel supply is reduced down to very lean fuel/air ratios. In addition, the atomizer nozzle should exhibit the highest possible atomization quality with respect to a combustion producing the least possible pollutants.

SUMMARY OF THE INVENTION

Accordingly, the object of this invention is to provide an atomizer nozzle for the atomization of liquid fuel with air supply which meets the aforementioned requirements.

According to the present invention, this object and other objects are achieved by the provisions of a novel atomizer nozzle having, among other things, an internal chamber which surrounds the latter in the form of a jacket, which are provided with several outlet openings which are in alignment in each case. Only a part of the air flows into the internal chamber and, apart from coarse atomization of the liquid fuel also flowing into the internal chamber, is essentially used there for uniformly distributing the fuel to its outlet openings. The other part of the air flows around the internal chamber through the external chamber and is concentrically mixed in with the coarsely atomized fuel emerging from the outlet openings of the internal chamber. This prevents liquid fuel fragments from coming into contact with the walls of the outlet openings of the external chamber. This effect usually occurs in the hitherto known atomizer nozzles and leads to a serious deterioration in the atomizer quality.

It was possible to achieve a considerable improvement in the flame stability by means of the atomizer nozzle according to the invention. The flame stability is directly influenced by the atomizer nozzle. The better the atomization quality, the more rapidly the fuel droplets can completely evaporate and feed the flame.

Advantageous developments of the atomizer nozzle according to the invention are characterized in the dependent patent claims.

BRIEF DESCRIPTION OF THE DRAWINGS

A more complete appreciation of the invention and many of the attendant advantages will be readily obtained as the same becomes better understood by reference to the following detailed description in connection with the accompanying drawings, wherein.

DESCRIPTION OF THE PREFERRED EMBODIMENT

Figure 1:
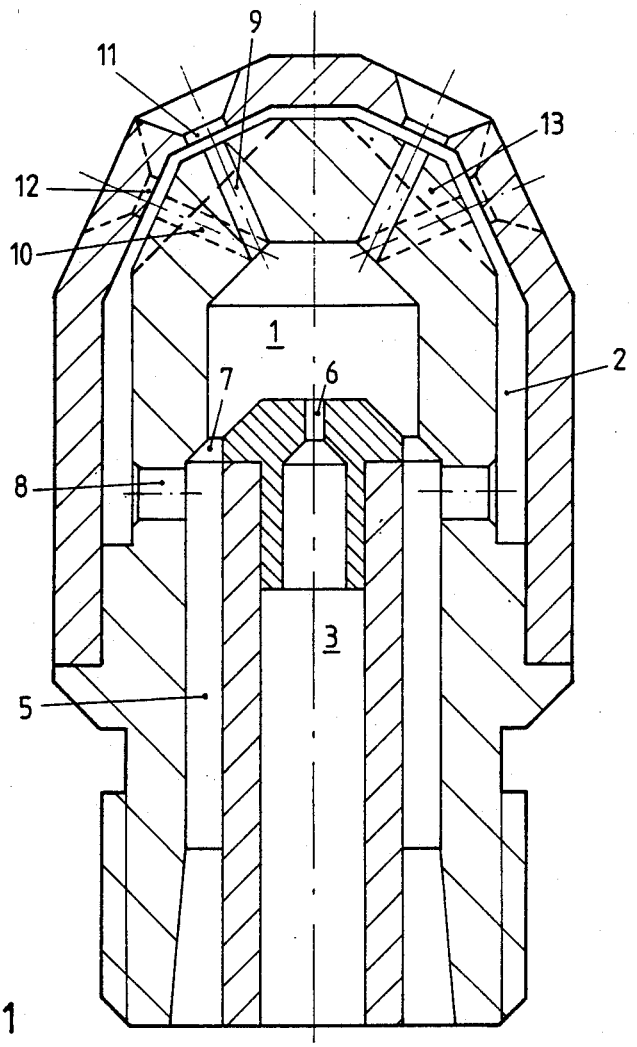
FIG. 1 shows a section of an atomizer nozzle according to the invention, with internal chamber and external chamber.

Referring now to the drawings, FIG. 1 shows a section of an atomizer nozzle having an internal chamber 1 and an external chamber 2. The external chamber 2 surrounds the internal chamber 1 in the form of a jacket. It exhibits an approximately hemispherical shell-shaped form.

A central fuel duct 3 and an air duct 5 surrounding the latter with the same axis 4 open into the internal chamber 1 via inlet openings 6 and 7, respectively. In addition, the air duct is connected to the external chamber 2 via connecting openings 8. The inlet opening 7 of the air duct 5 into the internal chamber exhibits either an annular cross-section or is formed by several annularly distributed individual openings. The same applies to the connecting openings 8.

The internal chamber 1 is provided with several outlet openings 9, 10 on its side opposite the inlet openings 6 and 7. Four outlet openings 9 and four outlet openings 10 are provided. The outlet openings 9 enclose an angle (polar angle) within a range of between 20° and 45°, but preferably of 25°, with the axis 4. The outlet openings 10 enclose an angle within a range of between 45° and 70°, but preferably at 65°, with the axis 4.

The outlet openings 9 and 10 are offset with respect to one another by an angle of 45° (azimuth angle) with respect to a rotation around the axis 4.

The cross-section of the internal chamber 1 tapers towards its outlet openings 9, 10. The internal chamber is first cylindrical and then frustoconical in the direction from its inlet openings 6, 7 towards its outlet openings 9, 10. The outlet openings 9, 10 start from the frustoconical part, from the same cross-section and with corresponding spacing from this axis with respect to the said direction or the axis 4. Accordingly, the outlet openings 9, 10 form an annular row of holes in the internal chamber 1.

The outlet openings 9, 10 of the internal chamber 1 open into the external chamber 2. The latter exhibits a corresponding number of outlet openings 11, 12 which are aligned with the outlet openings 9, 10 of the internal chamber. The cross-section of the outlet openings 11, 12 of the external chamber 2 is larger than the cross-section of the outlet openings of the internal chamber 1. It preferably corresponds to the sum of the cross-section of the outlet openings 9, 10 of the internal chamber 1 and to the annular cross-section of the openings of the external chamber 2 towards its outlet openings. The last mentioned annular cross-section is obtained as $\pi\chi D\chi W$, where D is the diameter of the outlet openings 11, 12 of the external chamber 2 and W is their width at their outlet openings 9, 10.

The outlet openings 11, 12 of the external chamber 2 expand conically towards the outside.

The atomizer nozzle described operates as follows:

A liquid fuel, for example oil, is supplied with slight overpressure via the fuel duct 3. The fuel flows through the inlet opening 6 into the internal chamber 1. The diameter of the inlet opening 6 is about 10-times smaller than the diameter of the fuel duct 3 and is selected within a range of between 0.6 mm and about 1.2 mm. Diameters which are much smaller than 0.6 mm are of disadvantage for reasons of the risk of blocking off the inlet opening.

The said diameter, the slight overpressure of the fuel in the fuel duct 3 and the length of the internal chamber 1 from its inlet opening 6 to its opposite wall are matched to each other in such a manner that a thin fuel jet impinging approximately on the center of the opposite wall is produced. The length of the internal chamber 1 should therefore not be greater than approximately 20 times the diameter of its inlet opening 6.

When it impinges of the wall opposite the inlet opening 6, the liquid fuel is coarsely atomized.

Atomizer air is supplied via the air duct 5, also with overpressure. This overpressure is about 1.05 to 1.3 times, preferably 1.2 times the outside pressure in the environment of the atomizer nozzle. The atomizer air has to supply the greatest proportion of the energy required for the atomization of the liquid fuel.

A proportion of the atomizer air supplied via the air duct 5 enters the internal chamber 1 via the inlet opening 7. There it is used for out driving the fuel, which has been coarsely atomized, as described before, by impinging on the wall opposite the inlet openings 6, 7, uniformly distributed through the oulet openings 9, 10.

It must be emphasized that at this point it is mainly a matter of uniformly distributing the fuel as well as possible to the individual outlet openings 9, 10 and rather less a matter of atomization with the quality finally desired.

Particularly good atomization cannot even be achieved by the driving-out of the oulet openings 9, 10 of the internal chamber 1 alone since a proportion of the fuel wets the walls of the outlet openings 9, 10 and forms a wall film. The desired high atomizer quality is only achieved by means of the external chamber 2.

Figure 2:
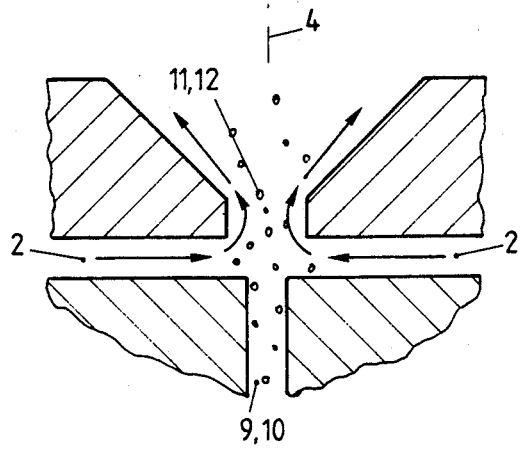
FIG. 2 shows in diagrammatic form the type of flow in the area of the outlet opening of the external chamber.

The main proportion of the atomizer air supplied through the air duct 5 enters via the connecting openings 8 into the external chamber 2 and in it flows round the internal chamber 1. At its outlet openings 11, 12 which are in alignment with the outlet openings 9, 10 of the internal chamber 1, the atomizer air flowing through the external chamber 2 places itself concentrically around the fuel aerosol emerging from the outlet openings 9, 10 of the internal chamber 1. This is illustrated in FIG. 2. This effect reliably prevents the fuel drops of the fuel aerosol emerging from the internal chamber 1 from coming into contact with the walls of the outlet openings 11, 12. As a result, considerable improvement in the atomizer quality is achieved.

So that the main proportion of the atomizer air, preferably approximately 70–80%, flows through the external chamber 2, its flow resistance and the flow resistance of the connecting openings 8 must be suitably dimensioned in relationship to the flow resistance through the internal chamber 1. With a total of eight outlet openings, the diameter of the outlet openings 9, 10 of the internal chamber 1 should be greater by approximately a factor of 1.33 than the diameter of its inlet opening 6.

It is of advantage if the highest flow velocity in the external chamber 2 occurs at its outlet openings 11, 12. This is why the flow cross-section of the external chamber 2 should be the smallest at these places.

It is also of advantage to construct the flow cross-section of the external chamber 2 between its outlet openings 11, 12 to be larger than between these outlet openings and the connecting openings 8. This results in a uniform sheathing of the fuel aerosol emerging from the outlet openings 9, 10 of the internal chamber 1. For this purpose, grooves 13, which are indicated dashed in FIG. 1, are preferably provided between the oulet openings 9, 10 and 11, 12 in the wall, separating the internal chamber 1 from the external chamber 2, on its side facing the latter.

Due to the angle selected for the outlet openings 9, 10 and 11, 12 with relation to the axis 4, in particular due to the outlet openings 9, 10 and 11, 12 being divided into two groups 9, 11 and 10, 12 having different angles, a spatial atomization characteristic is achieved which is optimum with respect to the intended use in a gas turbine combustion chamber. The outlet openings 10, 12 ensure reliable cross-ignition to adjacent similar burners. In contrast, the outlet openings 9, 11, due to their lesser angle with respect to the axis 4, ensure the stability of the flame down to very lean fuel/air ratios.

Finally, the selected number of only a total of eight outlet openings 9, 10 and 11, 12 is of advantage in as much as, with this number, no underpressure zone restricting their width can form in the center of the flow field. There is sufficient space for pressure equalization between the outlet openings.

Due to the angle selected for the outlet openings 9, 10 and 11, 12 with relation to the axis 4, in particular due to the outlet openings 9, 10 and 11, 12 being divided into two groups 9, 11 and 10, 12 having different angles, a spatial atomization characteristic is achieved which is optimum with respect to the intended use in a gas turbine combustion chamber. The outlet openings 10, 12 ensure reliable cross-ignition to adjacent similar burners. In constrast, the outlet openings 9, 11, due to their lesser angle with respect to the axis 4, ensure the stability of the flame down to very lean fuel/air ratios.

Finally, the selected number of only a total of eight outlet openings 9, 10 and 11, 12 is of advantage in as much as, with this number, no underpressure zone restricting their width can form in the center of the flow field. There is sufficient space for pressure equalization between the outlet openings.

What is claimed as new and desired to be secured by letters patent of the United States is:

1. An atomizer nozzle for atomizing liquid fuel with air supply, comprising:

an internal chamber, an approximately hemispherical shell-shaped external chamber surrounding the internal chamber, a central fuel duct and an air duct surrounding the central fuel duct and having the same axis as the central fuel duct;

the central fuel duct and the air duct having inlet openings communicating with the internal chamber;

the air duct also connected to the external chamber via at least one connecting opening;

the internal chamber having, opposite its inlet openings, several outlet openings which open into the external chamber;

the external chamber having a corresponding number of outlet openings which are in alignment with the outlet openings of the internal chamber and lead to the outside;

wherein:

the outlet openings of the internal chamber, opening into the outlet chamber, have a smaller cross-section than the outlet openings of the external chamber leading towards the outside;

the outlet openings of the external chamber expand conically towards the outside;

the smallest cross-section of the outlet openings of the external chamber in each case corresponds to the sum of the cross-section of the outlet openings of the internal chamber and the annular cross-section of the opening of the external chamber to its outlet openings.

2. An atomizer nozzle as claimed in claim 1, wherein:

two corresponding groups of outlet openings of the internal chamber and of the external chamber are provided;

the outlet openings of one of the two corresponding groups enclose an angle of between 20° and 45°, with the axis of the fuel duct and of the air duct, respectively;

the outlet openings of the other group enclose an angle of between 45° and 70°, with the said axis of the fuel duct.

3. An atomizer nozzle as claimed in claim 2, wherein:

said two corresponding groups of outlet openings for the internal chamber and the external chamber each comprise four outlet openings, the outlet openings of one of the two corresponding groups of outlet openings enclose an angle of 25° with the axis of the fuel duct and of the air duct, and the outlet openings of the other group enclose an angle of 65° with the axis of the fuel duct.

4. An atomizer nozzle for atomizing liquid fuel with air supply, comprising:

an internal chamber, an approximately hemispherical shell-shaped external chamber surrounding the internal chamber, a central fuel duct and an air duct surrounding the central fuel duct and having the same axis as the central fuel duct;

the central fuel duct and the air duct having inlet openings communicating with the internal chamber;

the air duct also connected to the external chamber via at least one connecting opening;

the internal chamber having, opposite its inlet openings, several outlet openings which open into the external chamber;

the external chamber having a corresponding number of outlet openings which are in alignment with the outlet openings of the internal chamber and lead to the outside;

wherein the flow resistances of the internal chamber and of the external chamber are selected, in particular by suitably dimensioning the effective flow cross-sections relative to one another, in such a manner that approximately 70–90% of the air from the air duct flows through the external chamber and, correspondingly, only approximately 10–30% of the air flows through the internal chamber.

5. An atomizer nozzle as claimed in claims 1, 2 or 3, wherein:

the cross-section of the internal chamber tapers towards its outlet openings; and the outlet openings of the internal chamber form an annular row of holes therein.

6. An atomizer nozzle as claimed in claims 1, 2 or 3, wherein:

the external chamber in each case has its minimum flow cross-section at its outlet openings; and the external chamber in each case has a larger flow cross-section between its outlet openings than between its outlet openings and the connecting openings to the air duct.

7. An atomizer nozzle as claimed in claims 1, 2 or 3, wherein:

the diameter of the inlet opening of the fuel duct into the internal chamber is at least 0.6 mm and at most 1.2 mm;

the length of the internal chamber in the direction of the axis of the fuel duct and of the air duct is greater by approximately a factor of 20 than the diameter of the inlet opening of the fuel duct into the internal chamber;

with a total of eight outlet openings in the internal chamber, the diameter of each of the outlet openings of the internal chamber is greater by approximately a factor of 1.33 than the diameter of the inlet opening of the fuel duct into the internal chamber; and the diameter of the fuel duct is greater by approximately a factor of 10 than that of its inlet opening into the internal chamber.

8. An atomizer nozzle as claimed in claims 1 or 2, wherein:

it is constructed for an overpressure of at least 1.3 bar in the air duct compared with its external environment.

* * * * *